US007729835B2

(12) United States Patent
Morris et al.

(10) Patent No.: US 7,729,835 B2
(45) Date of Patent: Jun. 1, 2010

(54) METHOD OF CONTROLLING A WORKING MACHINE

(75) Inventors: David Andrew Morris, Staffordshire (GB); Luciano Argentieri, Derby (GB); Andrew Stuart Mayer, Stoke on Trent (GB)

(73) Assignee: JCB Compact Products Limited, Stoke-on-Trent (GB)

( * ) Notice: Subject to any disclaimer, the term of this patent is extended or adjusted under 35 U.S.C. 154(b) by 330 days.

(21) Appl. No.: 11/842,698

(22) Filed: Aug. 21, 2007

(65) Prior Publication Data

US 2009/0055058 A1 Feb. 26, 2009

(51) Int. Cl.

| | |
|---|---|
| ***G06F 7/70*** | (2006.01) |
| ***G06F 19/00*** | (2006.01) |
| ***G06G 7/00*** | (2006.01) |
| ***G06G 7/76*** | (2006.01) |

(52) U.S. Cl. ..... 701/50; 172/9; 172/50; 180/315; 180/321; 180/324; 180/331; 700/83

(58) Field of Classification Search ..... 701/50, 701/35, 33; 180/315, 321, 324, 331; 700/17, 700/83; 172/9, 50

See application file for complete search history.

(56) References Cited

U.S. PATENT DOCUMENTS

| | | | | |
|---|---|---|---|---|
| 4,574,651 | A * | 3/1986 | Nordstrom | 74/471 XY |
| 5,424,623 | A * | 6/1995 | Allen et al. | 318/568.18 |
| 5,727,387 | A * | 3/1998 | Hosseini et al. | 60/327 |
| 5,740,053 | A * | 4/1998 | Iwama | 700/121 |
| 5,854,988 | A * | 12/1998 | Davidson et al. | 701/50 |
| 6,039,141 | A * | 3/2000 | Denny | 180/329 |
| 6,058,342 | A * | 5/2000 | Orbach et al. | 701/50 |
| 6,061,617 | A | 5/2000 | Berger et al. | |
| 6,148,593 | A * | 11/2000 | Heinsey et al. | 56/10.2 R |

(Continued)

FOREIGN PATENT DOCUMENTS

EP 1 462 408 A1 9/2004

(Continued)

OTHER PUBLICATIONS

Extended European Search Report for European Patent Application No. 07016287.0-1256, dated Jan. 31, 2008.

(Continued)

*Primary Examiner*—Khoi Tran
*Assistant Examiner*—Jaime Figueroa
(74) *Attorney, Agent, or Firm*—Marshall, Gerstein & Borun LLP

(57) ABSTRACT

A method is described of operating a working machine which includes a body, a ground engaging structure, and a working arm carrying a working implement, and an operator control for operating hydraulic actuators for effecting operating functions of the machine, the operator control mounting an additional control which is controllable to operate at least one selected actuator for effecting a selected operating function, the additional control providing inputs to a control device which responds proportionally to operate the selected actuator, the method including controlling the additional control to operate the selected actuator, and with the additional control being controlled to provide an input to the control device to achieve a desired operation of the actuator, activating a memory mode whereby the control device memorises the input and continues to operate the selected actuator in accordance with the memorised input.

16 Claims, 3 Drawing Sheets

U.S. PATENT DOCUMENTS

| | | | | |
|---|---|---|---|---|
| 6,282,477 | B1 * | 8/2001 | Gudat et al. | 701/50 |
| 6,292,729 | B2 * | 9/2001 | Falck et al. | 701/50 |
| 6,354,023 | B1 * | 3/2002 | Trahan et al. | 37/219 |
| 6,509,839 | B2 * | 1/2003 | Nagatuska | 340/691.1 |
| 6,571,902 | B2 * | 6/2003 | Heyne et al. | 180/321 |
| 6,591,591 | B2 * | 7/2003 | Coers et al. | 56/10.2 G |
| 6,681,551 | B1 * | 1/2004 | Sheidler et al. | 56/10.2 G |
| 6,694,240 | B1 * | 2/2004 | Swick et al. | 701/50 |
| 6,826,465 | B2 * | 11/2004 | Ishimoto et al. | 701/50 |
| 6,871,483 | B1 | 3/2005 | Panoushek | |
| 7,010,367 | B2 * | 3/2006 | Koch et al. | 700/85 |
| 7,079,931 | B2 * | 7/2006 | Sahm et al. | 701/50 |
| D555,676 | S * | 11/2007 | Haubrich et al. | D15/28 |
| 7,389,845 | B2 * | 6/2008 | Longueville et al. | 180/326 |
| 2001/0016794 | A1 | 8/2001 | Falck et al. | |
| 2002/0038548 | A1 * | 4/2002 | Sharkness et al. | 60/469 |
| 2002/0084135 | A1 | 7/2002 | Heyne et al. | |
| 2003/0056353 | A1 * | 3/2003 | Sharkness et al. | 29/401.1 |
| 2003/0056405 | A1 * | 3/2003 | Sharkness et al. | 37/348 |
| 2003/0226292 | A1 * | 12/2003 | Sharkness et al. | 37/348 |
| 2003/0230010 | A1 * | 12/2003 | Sharkness et al. | 37/348 |
| 2004/0256898 | A1 * | 12/2004 | Longueville et al. | 297/217.3 |
| 2004/0261300 | A1 * | 12/2004 | McClelland et al. | 37/348 |
| 2005/0034915 | A1 * | 2/2005 | Kumazawa | 180/331 |
| 2005/0065689 | A1 * | 3/2005 | Budde et al. | 701/50 |
| 2005/0082809 | A1 * | 4/2005 | Dix et al. | 280/764.1 |
| 2005/0085929 | A1 | 4/2005 | Koch et al. | |
| 2006/0237958 | A1 * | 10/2006 | Dix et al. | 280/764.1 |

FOREIGN PATENT DOCUMENTS

| | | | |
|---|---|---|---|
| EP | 1 586 712 | A2 | 10/2005 |
| EP | 1 640 512 | A2 | 3/2006 |
| GB | 2 361 908 | A | 11/2001 |
| JP | 02142906 | A | 6/1990 |
| WO | WO-00/36250 | | 6/2000 |
| WO | WO-02/46855 | | 6/2002 |
| WO | WO-02/090668 | | 11/2002 |

OTHER PUBLICATIONS

Search Report for GB 0608745.6, dated Oct. 4, 2006.

* cited by examiner

METHOD OF CONTROLLING A WORKING MACHINE

BACKGROUND TO THE INVENTION

This invention relates to a method of operating a working machine of the kind having a body, a ground engaging structure, and a working arm carrying a working implement.

It is known for operating functions such as the movement of a working arm of a working machine to be effected by hydraulic actuators which may be linearly acting actuators such as hydraulic rams, or rotationally acting actuators such as hydraulic motors, which are controlled by an operator using controls, usually from within a cab located in or on the body of the machine. It is also known for the operator controls to include proportional controls, so that a hydraulic actuator is operated to effect an operating function in correspondence with the direction and the magnitude of a control input to its operator control.

For example a working implement such as a boring tool may be carried by the working arm, and its operation i.e. speed of rotation of a boring bit, may be proportionally controlled by operating a rotational actuator of the tool in proportion to the direction and extent of movement of an operator control. When carrying out such a task, it can be advantageous for the rotational speed of the boring bit to be maintained at a certain level, but it can be difficult for an operator to control the boring tool rotational actuator for a sustained period to maintain the desired boring bit rotational speed, and/or the task may be interrupted, making it difficult for the operator to re-achieve the desired boring bit rotational speed.

SUMMARY OF THE INVENTION

According to one aspect of the present invention, we provide a method of operating a working machine which includes a body, a ground engaging structure, and a working arm carrying a working implement, and an operator control for operating hydraulic actuators for effecting operating functions of the machine, the operator control mounting an additional control which is controllable to operate at least one selected actuator for effecting a selected operating function. The additional control may provide inputs to a control device which responds proportionally to operate the selected actuator. The method may include controlling the additional control to operate the selected actuator, and with the additional control being controlled to provide an input to the control device to achieve a desired operation of the actuator, activating a memory mode whereby the control device memorises the input and continues to operate the selected actuator in accordance with the memorised input.

Thus a machine operator can use the memorised input to control the selected operating function rather than having to control the additional control to maintain an optimum input for the duration of the task.

Thus whereas when the selected actuator is operated by controlling the additional control, the selected actuated is proportionally controlled, e.g. greater or lesser additional control movement results in proportionally greater or lesser flow of hydraulic fluid to the selected actuator, when the memory mode is activated, the control device ensures that a constant flow of hydraulic fluid is provided to the selected actuator to maintain the desired actuator operation.

Preferably the control device continues to operate the selected actuator in accordance with the memorised input until the memory mode is deactivated or until the memory mode is activated to memorise an alternative input from the additional control. Manual operator control of the selected actuator using the additional control, for effecting the selected operating function may be resumed, by deactivating the memory mode.

In the event that a task requiring the selected operating function is interrupted, desirably it is possible to recall the memorised input and for the selected operating function to be performed in accordance with the memorised input, in order that the additional control does not have to be controlled again to regain the desired setting.

Thus the method of the invention may include reactivating the memory mode, such that the memorised input to the control device is recalled and the desired operation of the selected actuator corresponding to the memorised input is performed.

To activate the memory mode, and so that the control device memorises the current input from the additional control, a memory control may be operated for a period which is greater than or equal to a predetermined period. The memory control may be operated for less than the predetermined period to activate the memory mode by recalling the last memorised input.

Particularly but not exclusively In the case of a selected operating function which a machine operator may require repeatedly to perform in different locations for example, such as for examples only the operation of a boring tool or forward drive of the machine to give another example of an operating function which may be selected for control by the additional control, the memorised input may remain memorised by the control device even when an engine of the working machine which provides power for the machine functions, is deactivated.

The additional control may be capable of controlling only one selected operating function such as the operation of a working implement such as a boring tool, or may be capable of controlling a plurality of alternative operating functions, including by way of further examples only, forward drive of the machine, or the movement of one part of the working arm relative to another for a particular purpose such as grading. Thus the method may include selecting the operating function to be controlled by the additional control by actuating a selector switch to transfer control of the selected operating function to the additional control.

According to a second aspect of the invention we provide a control system for a working machine which includes a body, a ground engaging structure, and a working arm carrying a working implement. The control system may include an operator control for operating hydraulic actuators for effecting operating functions of the machine, and the operator control may mount an additional control which is controllable to operate at least one selected actuator for effecting a selected operating function. The additional control may provide inputs to a control device which responds proportionally to operate the selected actuator, the control device including a memory for memorising an input from the additional control which achieves a desired operation of the actuator, so that upon a memory mode being activated, the control device memorises the input and continues to operate the selected actuator in accordance with the memorised input.

The invention has particularly but not exclusively been developed where the operator control which mounts the additional control, is a joystick which is moveable to operate other hydraulic actuators to effect other operating functions of the machine, joystick movements providing inputs to the control device which responds by operating one or more of the respective other actuators. However the invention may be applied where the operator control is for example, a control lever which is mechanically connected to a valve block to control operating functions e.g. by moving spools of the valve block.

In each case though, the additional control may be a thumbwheel potentiometer which is mounted by the operator control so as to be controllable e.g. by an operator's thumb.

The control system may include a selector switch for transferring control of the selected operating function to the additional control, and in an embodiment in which there is a second operator control for operating hydraulic actuators for effecting operating functions of the machine, the selector switch may be mounted on the second operator control. However, if such a selector switch is capable of selecting between a plurality of alternative operating functions to be controlled by the additional control, and transferring control of a selected one of the plurality of operating functions to the additional control, the selector switch may more conveniently be provided elsewhere, for example only, on a dashboard or other control panel of the working machine.

Where the selector switch is provided on a second operator control, and the operator control mounting the additional control is a joystick, the second operator control may be a second joystick which is moveable to operate hydraulic actuators to effect operating functions of the machine, second joystick movements providing inputs to the control device which responds by operating one or more of the respective other actuators.

Preferably the memory mode is activated using a memory control. The memory control may be a member located on the or one of the operator controls which, when operated e.g. pressed, activates the memory mode. Preferably the memory control is provided on the second operator control.

When the memory control is operated for a period greater than or equal to a predetermined period, the memory mode may be activated with the control device to memorise the current input from the additional control, whereas when the memory control is operated for a period less than the predetermined period, the memory mode may be activated with the control device recalling the last memorised input.

According to a third aspect of the present invention we provide a working machine having a control system according to the second aspect of the invention.

BRIEF DESCRIPTION OF THE DRAWINGS

Embodiments of the invention will now be described with reference to the accompanying drawings, in which.

DESCRIPTION OF THE PREFERRED EMBODIMENT

Figure 1:
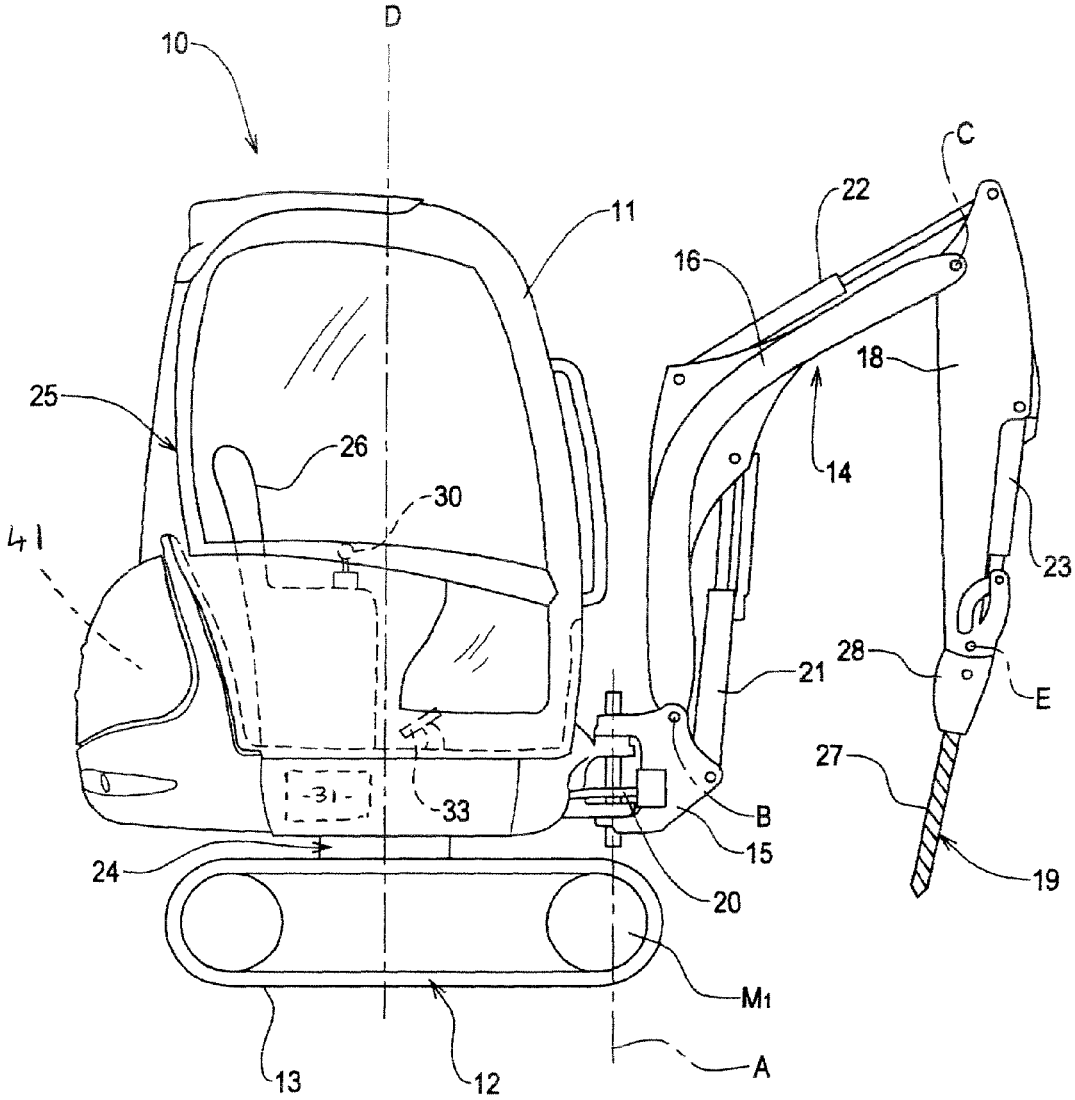
FIG. 1 is an illustrative side view of a working machine in accordance with the third aspect of the invention.

Referring to the drawings, there is shown a working machine 10 which in the example to be described with reference to the drawings is an excavating machine which includes a body 11 and a ground engaging structure 12, which in this example includes a pair of tracks 13, driven by respective hydraulically powered track motors one of which is indicated illustratively by the reference M1, through respective track drive sprockets. In this example, the body 11 is rotatable about a generally upright slew axis D relative to the ground engaging structure 12 by a hydraulic actuator which is a hydraulic motor, the general location for which is identified at 24.

It will be apparent from the description below that the invention may be applied to other than an excavator, e.g. a loading machine, and that such other kind of working machine may have an alternative ground engaging structure e.g. having ground engaging wheels rather than tracks.

A working machine 10 with which the invention Is concerned does however have a working arm 14, for excavating and/or loading. In the example illustrated, the working arm 14 is an excavating arm 14 which includes a boom part 16 from which depends a dipper arm 18. A working implement 19, which in this example is a boring tool, is carried by the dipper arm 18.

The working arm 14 is mounted on a mounting assembly 15 for swinging rotation relative to the body 11, about a substantially upright axis A, and for up and down movement about a first generally horizontal axis B relative to the body 11. The rotational movement of the arm 14 about the upright axis A is effected by a first hydraulic actuator 20 (only partly seen in FIG. 1) which acts between the body 11 and the mounting assembly 15, and arm 14 movement about the first generally horizontal axis B is effected by a second hydraulic actuator 21, which acts between the mounting assembly 15 and the boom part 16. A third hydraulic actuator 22 is provided for moving the dipper arm 18 with respect to the boom part 16 about a further substantially horizontal axis C.

The second and third hydraulic actuators 21 and 22 act linearly to enable the working implement 19 to be raised, lowered and moved closer to or further from the machine body 11 as required. A fourth hydraulic actuator 23 enables the working implement 19 to be rotated about another axis E relative to the dipper arm 18, and yet another hydraulic actuator, i.e. a hydraulic motor indicated at 28, is operative to rotate a boring tool bit 27 to effect the working operation of boring.

The first, second, third and fourth hydraulic actuators 20-23, and the motors 24 and 28 for driving the ground engaging structure 12 and the boring tool 19, and the track motors M1, are controlled by an operator from within a cab structure 25 of the machine 10. The cab structure includes a seat 26 which has arm-mounted operator joystick controls 30

In the present example, the working machine 10 is provided with at least first, second and third operator controls which provide inputs to a control device 31 which may be provided anywhere practical in the machine 10, the control device 31 responds to the inputs to operate the various functions of the machine. In the present example, the first operator control is a joystick 30*a* mounted on the operator's right hand side of the seat 26, and the second operator control is a joystick 30*b*, mounted on the operator's left hand side of the seat 26. The third operator control in this example is a foot pedal 33. It will be apparent that the operator controls do not necessarily have to be provided in this particular arrangement, for example the joysticks 30*a*, 30*b* could instead be floor mounted levers.

The joysticks 30*a*, 30*b* are servo controls which when activated, provide hydraulic or electric servo input signals to the control device 31 which may be a control valve assembly or an electronic control unit, to operate respective hydraulic actuators. Typically the first 30*a* and second 30*b* joystick operator controls would be controlled to operate selected operating functions of the machine 10. Particular operating functions to be controlled may be changeable so the joysticks may in one operating mode be used to operate the track motors M1 to effect forward or reverse drive of the machine 10, or in another operating mode the joystick controls 30*a*, 30*b* may be used to operate the linear first, second, third and fourth actuators 21-23 to operate working arm 14 functions, as required.

Figure 3:
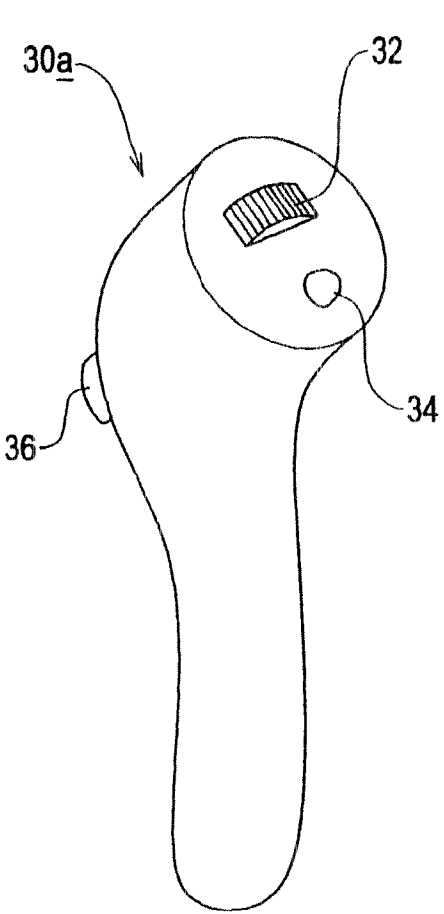
FIG. 3 is a perspective illustrative view of a first operator control for a control system in accordance with the second aspect of the invention.
Figure 4:
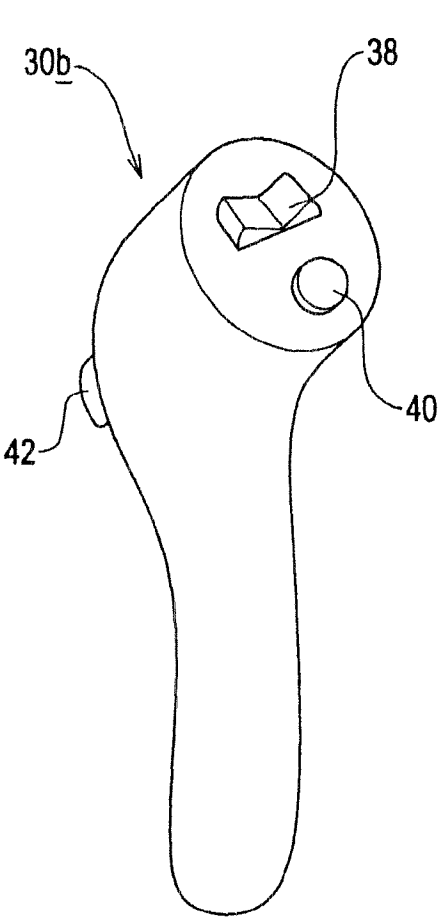
FIG. 4 is a perspective illustrative view of a second operator control of the control system.
Figure 2:
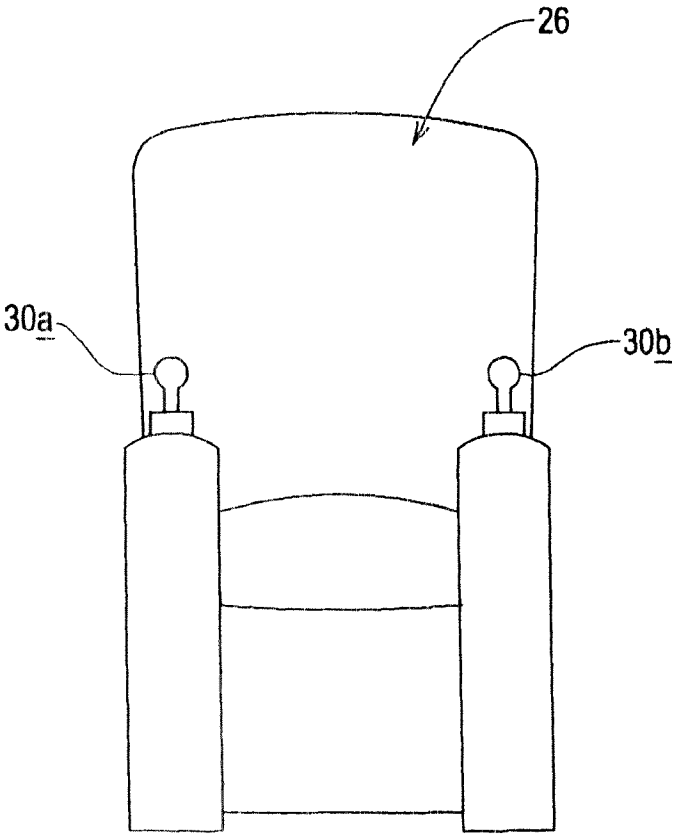
FIG. 2 is an illustrative front view of a working machine operator's seat having first and second operator controls mounted thereon.

As shown in FIG. 3, the first, right hand, joystick operator control 30*a* provides a mounting for an additional control 32 which in this example is a thumbwheel. The first joystick operator control 30*a* also has an indicator light 34, and a horn control button 36. As shown in FIG. 4, the second, left hand, operator control joystick 30*b* is provided with a function selection switch, which in this example is a rocker switch 38, having first and second positions for selecting alternative operating functions for the additional, thumbwheel, control 32 to control.

The rocker switch 38 also has a third position which is a control selector for transferring control of the operating functions otherwise selectable by the selector switch 38, between the additional, thumbwheel, control 32 and the third operator control, i.e. the foot pedal 33. Thus in this example the selector switch 38 is a three position rocker switch, but other kinds of selector switch 38 which enable an operating function to be controlled by the additional control 32 to be selected, may be utilised. For example, particularly but not exclusively where there are a larger number of alternative operating functions from which selection may be made for transferring control to the additional control 32, a rotational or other kind of selector switch, or even an electronic display menu style selector switch may be utilised. Further the selector switch 38 need not be provided on the second operator control joystick 30*b*, but this could be dashboard or other control panel mounted as required.

In the example, the second left hand operator control joystick 30*b* is further provided with a function selector 40 and a memory control, namely a trigger button 42.

In the present example, the additional, thumbwheel, control 32 is a thumbwheel potentiometer. An operator can rotate the thumbwheel 32 to the left or the right from a centre position, with respect to the joystick 30*a*. When the operator releases the thumbwheel 32, it is returned by a spring to its neutral centre position.

In the present example, the additional control 32 can be used alternatively to signal the control device 31 to control a first selected operating function, namely the rotation of the boring tool bit 27 effected by the hydraulic motor 28, and a second selected operating function namely the swinging rotation of the working arm 14 about upright axis A with respect to the machine body 25. The additional, thumbwheel, control 32 is only able to control one selected operating function at any one time. The operator selects whether the additional, thumbwheel, control 32 is used to control the first or second selected operating function, by means of the selector switch 38 on the second operator control joystick 30*b*.

Selecting the first position of the rocker switch 38 transfers control of the first selected operating function, that is the control of the hydraulic motor 28 of the boring tool 19, to the additional, thumbwheel, control 32. Selecting the second position of the rocker switch 38 transfers control of the second selected operating function, that is the swinging rotation of the working arm 14 with respect to the body 25, about axis generally upright axis A, to the additional, thumbwheel control 32.

Selecting the third position of the selector switch 38 transfers control of the selected operating functions to the foot pedal 33, the operator selecting whether the foot pedal 33 is required to control the first or the second selected operating function, by pressing the function selector button 40. The function selector button 40 is a toggle button of known type.

The indicator light 34 on the first operator control joystick 30*a* indicates whether the selected operating function is being controlled by the additional, thumbwheel, control 32 or by the foot pedal 33.

The additional, thumbwheel, control 32, like the joysticks 30*a*, 30*b* in this example, provides inputs to the control device 31 which responds by operating respectively, the hydraulic motor 28 of the boring tool 19 when the first selected operating function is controlled by the additional control 32, or the first actuator 20 when the second selected operating function is controlled by the additional control 32, all depending proportionally upon the direction and extent of rotation of the thumbwheel 32.

Figure 5:
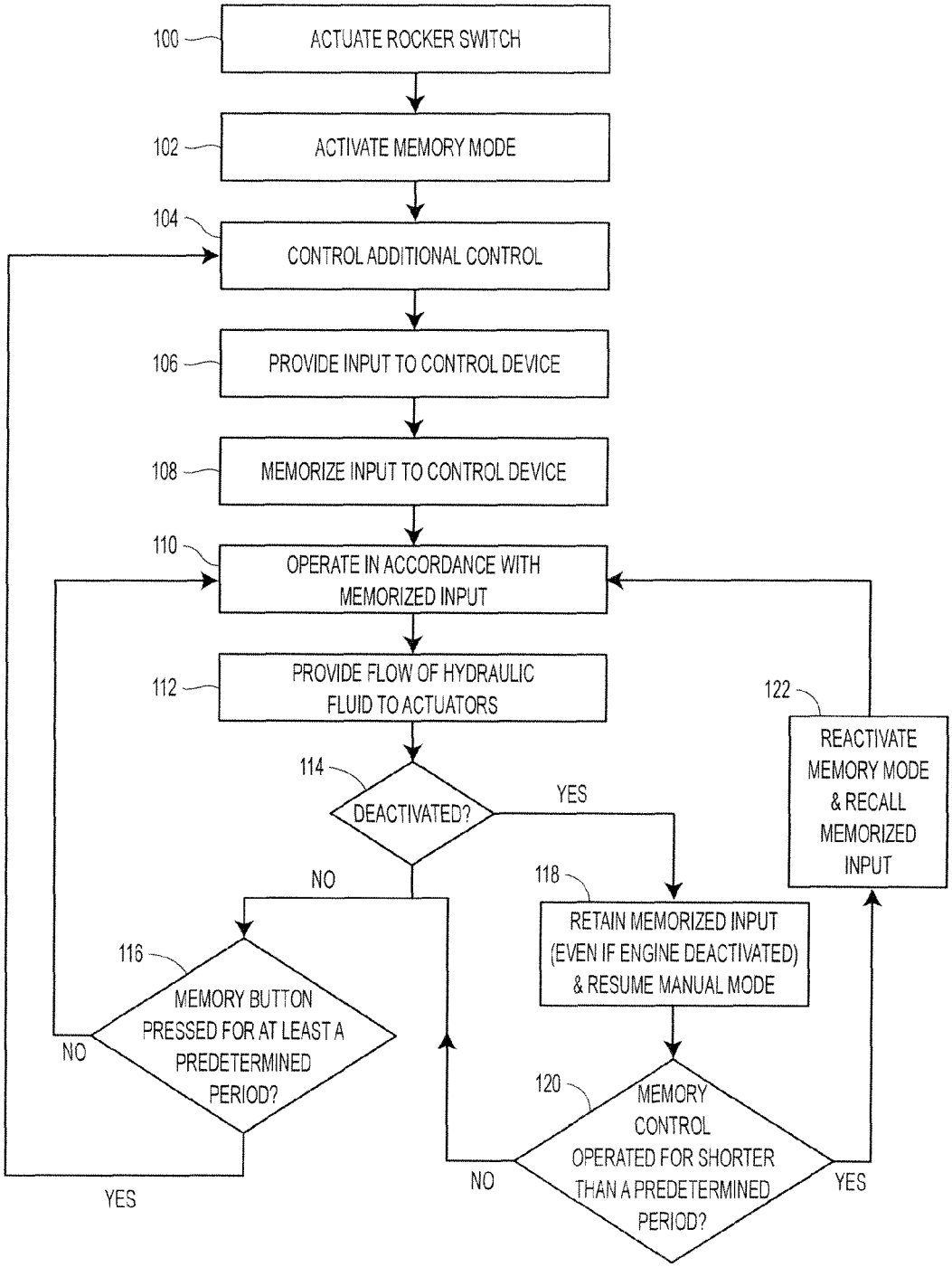
FIG. 5 is a flow chart setting forth a method of operating a working machine in accordance with the invention.

With reference now to FIG. 5, a method of operating the working machine 10 will be described. An operator can actuate the rocker switch 38 to transfer control of the first or second selected operating function to the additional control 32 (Block 100). When the rocker selector switch 38 is in the first or second position, such that the additional, thumbwheel, control 32 is controlling a selected operating function, the operator may activate a memory mode (Block 102). Then, the operator may control the additional, thumbwheel, control 32 (Block 104) to provide input to the control device 31 (Block 106), as discussed above.

The memory mode enables an input from the additional, thumbwheel, control 32 which results in a desired operation e.g. hydraulic motor 28 rotational speed, to be memorised by the control device 31 (Block 108). The memory mode is activated by operating the memory control 42 on the second operator control joystick 30*b* in this example, is a button which, when depressed for a period which is greater than or equal to a predetermined period, causes the control device 31 to memorise the input currently being received from the additional, thumbwheel, control 32. In this example, when the memory control button 42 is operated to activate the memory mode, the indicator light 34 on the first operator control joystick 30*a* flashes until the predetermined period has elapsed.

Once an input has been memorised, the hydraulic actuator effecting the selected operating function, is controlled by the control device 31 in memory mode in accordance with that memorised input (Block 110), until the memory mode is deactivated, or until the memory control button 42 is pressed to activate the memory mode to memorise a new input in the control device. The memory control button 42 is a toggle button which, if pressed for a period which is shorter than the predetermined period either, when the memory mode is activated, de-activates the memory mode, or where the memory mode is deactivated, activates the memory mode but recalling the last memorised input.

When the memory mode is activated, the control device 31 controls the flow of hydraulic fluid to the respective selected actuator to effect the respective selected operating function, by maintaining a constant flow of hydraulic fluid to the actuator, regardless of the operation or otherwise of the additional, thumbwheel, control 32 (Block 112). Such constant hydraulic fluid flow is maintained at the selected magnitude and/or in the selected direction until the memory mode is deactivated (Block 114), or until a new input from the additional thumbwheel, control 32 is memorised by pressing the control button 42 for at least the predetermined period (Block 116).

The control device 31 retains the memorised input and resumes manual operator control when the memory control button 42 is pressed to deactivate the memory mode (Block 118), even when an engine 41 of the working machine 10 which provides power for the various machine functions, has been deactivated, so that if the task is interrupted by pressing the memory control button 42 for less than a predetermined period (Block 120), the operator can recall the memorised input (Block 122) and continue the task without having to adjust the additional, thumbwheel, control 32 again to find the optimum setting.

Although the invention has been described in terms of an excavating machine 10 with a two part working arm 14, the invention may be applied to other kinds of working machines having one or more than two part, or telescopic, working arms for examples only.

The selected operating function the control of which is transferred to and effected by the additional, thumbwheel or other kind of control 32 could be any of the operating functions of the working machine 10 where it is desirable to be able to memorise an input from the additional control 32 either for immediate or future use. Examples of alternative operating functions which may be selected include the forward drive of the machine effected by the hydraulically driven track motors M1 where such are provided, in order to achieve a constant driving speed, or the movement of the dipper arm 18 relative to the boom part 16 which may be effected by the second actuator 22, e.g. during a grading task, when a consistent speed of movement of a levelling tool e.g. a bucket may be desirable.

It is envisaged that a suitable selector switch 38, e.g. provided by selectable menu items on a display screen, may enable any one of a large number of different machine operating functions to be selected for control by the additional control 32, with any input from the additional control 32 which results in a desired operating function being effected, being memorisable by the control device 31 upon operating the memory control 42, for immediate and/or future use. If desired, one or a plurality of different inputs for each selectable operating function may be memorised by the control device 31, e.g. so that different machine operators may store preferred settings.

If desired, instead of the memory control 42 being a button on the second operator control 30*a*, this may be provided elsewhere, e.g. on a dashboard or other control panel, or even by e.g. pushing the additional control 32 which is otherwise rotatable to vary the input to the control device 31.

The control device 31 which receives inputs from the various operator controls, including the additional control 32, the function selector 40 and the memory control 42 etc. may be an electronic control device, or an electro-hydraulic control device, which may include one or a plurality of operationally interconnected units. The control device 31 may be operative to control the various hydraulic actuators by operating spools of one or more valve blocks as is well known in the art. Where the first and second operator controls 30*a*, 30*b* are not servo controls such as joysticks but, usually floor mounted, control levers mechanically connected directly to a valve block, the control device 31 would be operable to effect control of a selected operating function in response to controlled operation of the additional control 32 only.

The invention claimed is:

1. A method of operating a working machine which includes a body, a ground engaging structure, and a working arm carrying a working implement, and an operator control for operating hydraulic actuators for effecting operating functions of the machine, the operator control mounting an additional control which is controllable to operate at least one selected actuator for effecting a selected operating function, the additional control providing inputs to a control device which responds proportionally to operate the selected actuator, the method including controlling the additional control to operate the selected actuator, and with the additional control being controlled to provide an input to the control device to achieve a desired operation of the actuator, activating a memory mode by operating a memory control whereby the control device memorises the input and a constant flow of hydraulic fluid is provided to the selected actuator, and the control device continues to operate the selected actuator in accordance with the memorised input until the memory mode is deactivated by operating the memory control or until the memory mode is activated by operating the memory control to memorise an alternative input from the additional control.

2. The method according to claim 1 wherein manual operator control of the selected actuator for effecting the selected operating function is resumed by deactivating the memory mode.

3. The method according to claim 2 including reactivating the memory mode by operating the memory control, such that the memorised input to the control device is recalled and the desired operation of the selected actuator corresponding to the memorised input is performed.

4. The method according to claim 1 wherein the memory mode is activated and the control device memorises the current input from the additional control by operating the memory control for a period which is greater than or equal to a predetermined period.

5. The method according to claim 4 which includes operating the memory control for less than the predetermined period to activate the memory mode by recalling the last memorised input.

6. The method according to claim 1 wherein the machine includes an engine for providing power for the actuators for effecting the operating functions, and the memorised input remains memorised by the control device when the engine of the working machine is deactivated.

7. The method according to claim 1 wherein the method includes actuating a selector switch to transfer control of the selected operating function to the additional control.

8. A control system for a working machine which includes a body, a ground engaging structure, and a working arm carrying a working implement, the control system including an operator control for operating hydraulic actuators for effecting operating functions of the machine, the operator control mounting an additional control which is controllable to operate at least one selected actuator for effecting a selected operating function, the additional control providing inputs to a control device which responds proportionally to operate the selected actuator, the control device including a memory for memorising an input from the additional control which achieves a desired operation of the actuator, so that upon a memory mode being activated by operating a memory control, the control device memorises the input and a constant flow of hydraulic fluid is provided to the selected actuator, and the control device continues to operate the selected actuator in accordance with the memorised input until the memory mode is deactivated by operating the memory control or until the memory mode is activated by operating the memory control to memorise an alternative input from the additional control.

9. The control system according to claim 8 wherein the operator control is a joystick which is moveable to operate other hydraulic actuators to effect other operating functions of the machine, joystick movements providing inputs to the control device which responds by operating one or more of the respective other actuators.

10. The control system according to claim 8 wherein the additional control is a thumbwheel potentiometer.

11. The control system according to claim 8 wherein a selector switch is provided for transferring control of the selected operating function to the additional control.

12. The control system according to claim 11 wherein the system includes a second operator control for operating hydraulic actuators for effecting operating functions of the machine, the selector switch being mounted on the second operator control.

13. The control system according to claim 12 wherein the second operator control is a second joystick which is moveable to operate hydraulic actuators to effect operating functions of the machine, second joystick movements providing inputs to the control device which responds by operating one or more of the respective other actuators.

14. The control system according to claim 8 wherein the memory control is a member located on the or one of the operator controls which, when operated, activates the memory mode.

15. The control system according to claim 14 wherein when the memory control is operated for a period greater than or equal to a predetermined period, the memory mode is activated with the control device to memorise the current input from the additional control, and when the memory control is operated for a period less than the predetermined period, the memory mode is activated with the control device recalling the last memorised input.

16. A working machine having a control system which includes a body, a ground engaging structure, and a working arm carrying a working implement, the control system including an operator control for operating hydraulic actuators for effecting operating functions of the machine, the operator control mounting an additional control which is controllable to operate at least one selected actuator for effecting a selected operating function, the additional control providing inputs to a control device which responds proportionally to operate the selected actuator, the control device including a memory for memorising an input from the additional control which achieves a desired operation of the actuator, so that upon a memory mode being activated by operating a memory control, the control device memorises the input and a constant flow of hydraulic fluid is provided to the selected actuator, and the control device continues to operate the selected actuator in accordance with the memorised input until the memory mode is deactivated by operating the memory control or until the memory mode is activated by operating the memory control to memorise an alternative input from the additional control.

* * * * *